United States Patent [19]

Beaver et al.

[11] Patent Number: 5,035,789

[45] Date of Patent: Jul. 30, 1991

[54] ELECTROCATALYTIC CATHODES AND METHODS OF PREPARATION

[75] Inventors: Richard N. Beaver, Angelton; Carl E. Byrd, Richwood; Stephen L. Kelly, Angelton, all of Tex.

[73] Assignee: The Dow Chemical Company, Midland, Mich.

[21] Appl. No.: 529,990

[22] Filed: May 29, 1990

[51] Int. Cl.[5] ..... C25B 11/08; B05D 5/12

[52] U.S. Cl. ..... 204/290 R; 427/125; 427/126.5; 427/255.4; 427/383.7; 427/436

[58] Field of Search ..... 204/290 R, 291, 292, 204/293; 502/101; 427/77.1, 125, 128, 435, 126.5, 255.4, 436, 383.1, 383.3, 383.5, 383.7

[56] References Cited

U.S. PATENT DOCUMENTS

| | | | |
|---|---|---|---|
| 3,751,296 | 8/1973 | Beer | 204/290 F |
| 4,157,943 | 6/1979 | Scarpellino, Jr. et al. | 204/37 R |
| 4,238,311 | 12/1980 | Kasuya | 204/290 R |
| 4,414,071 | 11/1983 | Cameron et al. | 204/242 |
| 4,443,317 | 4/1984 | Kawashima et al. | 204/290 F |
| 4,465,580 | 8/1984 | Kasuya | 204/290 R |
| 4,572,770 | 2/1986 | Beaver et al. | 204/98 |
| 4,584,085 | 4/1986 | Beaver et al. | 204/290 R |
| 4,668,370 | 5/1987 | Pellegri | 204/252 |
| 4,724,052 | 2/1988 | Nidola | 204/16 |
| 4,760,041 | 7/1988 | Beaver et al. | 204/292 |
| 4,798,662 | 1/1989 | Clerc-Renaud et al. | 204/290 R |

FOREIGN PATENT DOCUMENTS

| | | |
|---|---|---|
| 0129088 | 5/1984 | European Pat. Off. . |
| 0129374 | 5/1987 | European Pat. Off. . |
| 0129231 | 1/1988 | European Pat. Off. . |
| 011178 | of 1977 | Japan . |

OTHER PUBLICATIONS

*Kirk-Othmer Ency. of Chem. Technology*, 3rd Ed., (John Wiley & Sons 1978) pp. 799-865, W. J. Moore, *Physical Chemistry*, (Prentice Hall 1962), 3rd Ed., pp. 406-408.

*Primary Examiner*—John F. Niebling
*Assistant Examiner*—Kathryn Gorgos

[57] ABSTRACT

Cathodes useful in an electrolytic cell, such as a chlor-alkali cell, are disclosed which have a metallic-surfaced substrate coated with a catalytic coating composition. In one aspect, the catalytic coating includes a base layer of at least one primary electrocatalytic metal with particles of at least one electrocatalytic metal oxide entrapped therein. In another aspect, at least one upper oxide layer is formed on the base layer. Each upper oxide layer includes a substantially heterogeneous mixture of at least one primary electrocatalytic metal oxide and at least one secondary electrocatalytic metal oxide. The catalytic coatings are tightly adherent to the underlying substrate, resist loss during cell operation and exhibit low hydrogen overvoltage potentials. Also disclosed are methods for preparing the cathodes.

37 Claims, No Drawings

ELECTROCATALYTIC CATHODES AND METHODS OF PREPARATION

FIELD OF THE INVENTION

This invention concerns electrocatalytic cathodes useful in an electrolysis cell, such as a chlor-alkali cell. The invention also concerns methods for preparing the cathodes.

BACKGROUND OF THE INVENTION

There are three types of electrolytic cells commercially used for producing halogen gas and aqueous caustic solutions from alkali metal halide brines, a process referred to by industry as a chlor-alkali process. The three types of cells are: (1) a mercury cell, (2) a diaphragm cell and (3) a membrane cell. The general operation of each cell is known to those skilled in the art and is discussed in Volume 1 of the Kirk-Othmer Encyclopedia of Chemical Technology, 3rd Ed. (John Wiley & Sons 1978) at page 799 et. seq., the relevant teachings of which are incorporated herein by reference.

The three cells differ in various respects. In the mercury cell, alkali metal ions produced by electrolysis of an alkali metal salt form an amalgam with mercury. The amalgam reacts with water to produce aqueous sodium hydroxide, hydrogen gas and free mercury. The mercury is recovered and recycled for further use as a liquid cathode. In a diaphragm cell, an alkali metal halide brine solution is fed into an anolyte compartment where halide ions are oxidized to produce halogen gas. Alkali metal ions migrate into a catholyte compartment through a hydraulically-permeable microporous diaphragm disposed between the anolyte compartment and the catholyte compartment. Hydrogen gas and aqueous alkali metal hydroxide solutions are produced at the cathode. Due to the hydraulically-permeable diaphragm, brine may flow into the catholyte compartment and mix with the alkali metal hydroxide solution. A membrane cell functions similar to a diaphragm cell, except that the diaphragm is replaced by a hydraulically-impermeable, cationically-permselective membrane which selectively permits passage of hydrated alkali metal ions to the catholyte compartment. A membrane cell produces aqueous alkali metal hydroxide solutions essentially uncontaminated with brine. Presently, the most widely used chlor-alkali processes employ either diaphragm or membrane cells.

The minimum voltage required to electrolyze a sodium chloride brine into chlorine gas, hydrogen gas and aqueous sodium hydroxide solution may be theoretically calculated by the use of thermodynamic data. However, in reality, production at the theoretical voltage is not attainable and a higher voltage, i.e., a so-called overvoltage, must be applied to overcome various inherent resistances within the cell. Reduction in the amount of applied overvoltage leads to a significant savings of energy costs associated with cell operation. A reduction of even as little as 0.05 volts in the applied overvoltage translates to significant energy savings when processing multimillion-ton quantities of brine. As a result, it is desirable to discover methods which minimize overvoltage requirements.

Throughout the development of chlor-alkali technology, various methods have been proposed to reduce the overvoltage requirements. To decrease the overvoltage in a diaphragm or a membrane cell, one may attempt to reduce electrode overvoltages, i.e., a so-called hydrogen overvoltage at the cathode; to reduce electrical resistance of the diaphragm or membrane; to reduce electrical resistance of the brine being electrolyzed; or to use a combination of these approaches. Some research concentrates on minimizing cell overvoltage by proposing design modifications to the cells.

It is known that the overvoltage for an electrode is a function of its chemical characteristics and current density. See, W. J. Moore, *Physical Chemistry*, pp. 406–408 3rd Ed. (Prentice Hall 1962). Current density is defined as the current applied per unit of actual surface area on an electrode. Techniques which increase the actual surface area of an electrode, such as acid etching or sandblasting the surfaces thereof, result in a corresponding decrease of the current density for a given amount of applied current. Inasmuch as the overvoltage and current density are directly related to each other, a decrease in current density yields a corresponding decrease in overvoltage. The chemical characteristics of materials used to fabricate the electrode also impact overvoltage. For example, electrodes incorporating an electrocatalyst accelerate kinetics for electrochemical reactions occurring at the surface of the electrode.

It is known that certain platinum group metals, such as ruthenium, rhodium, osmium, iridium, palladium, platinum, and oxides thereof are useful as electrocatalysts. Electrodes may be fabricated from these metals, but more economical methods affix the platinum group metals to a conductive substrate such as steel, nickel, titanium, copper and so on. For example, U.S. Pat. No. 4,414,071 discloses coatings of one or more platinum group metals deposited as a metallic layer on an electrically-conductive substrate. Japanese Patent No. 9130/65, OPI application numbers 131474/76 and 11178/77, refers to use of a mixture of at least one platinum group metal oxide with a second metal oxide as a cathode coating.

Also known in the art are coatings of catalytic metals in both an elemental and combined form. U.S. Pat. Nos. 4,724,052 and 4,465,580 are similar and teach preparation of a coating on a metallic substrate by electrolytic deposition of catalytic metals and catalytic particles thereon. U.S. Pat. No. 4,238,311 teaches a cathode coating consisting of fine particles of platinum group metals, platinum group metal oxides or a combination thereof, affixed to a nickel substrate. Such processes are undesirable due to either the need for expensive electrolytic hardware or waste disposal problems.

Some research has concentrated on cathodes having layered catalyst coatings. U.S. Pat. No. 4,668,370 discusses a coating having an interlayer deposited by electrolytic deposition, the interlayer being an inert metal with particles of a ceramic material, such as platinum group metal oxides, dispersed therein. On top of the interlayer is a layer of ceramic material which includes metal oxides. U.S. Pat. No. 4,798,662 discloses a coating having a base layer that includes the platinum group metals, metal oxides and mixtures thereof. On top of this base layer is a layer of metal, such as nickel or cobalt.

Industry has recently directed attention toward development of "zero-gap" electrolytic cells wherein an electrode, such as the cathode, is placed in contact with a membrane. This arrangement reduces the required overvoltage of prior "gap" cell designs by elimination of electrical resistance caused by electrolyte being disposed between the cathode and the membrane. In some zero-gap cells, it is advantageous to employ an extremely thin cathode to provide close contact between the cathode and the membrane and, thereby, fully utilize the advantage of the zero-gap cell design. A thin substrate also provides flexibility, which helps prevent damage to the membrane caused by contact with the cathode. However, use of a thin substrate presents problems in maintaining adherence of electrocatalytic coatings to the substrate. Substrates coated by prior methods can experience significant coating loss by decrepitation shortly after being placed in service, especially where the substrate is flexible. Thin substrates coated by electrolytic methods as previously described also tend to become rigid and lose flexibility. Accordingly, it is desirable to develop a coating which is both resistant to loss during operation and which allows for retention of substrate flexibility.

Coatings of catalytic metals possessing low hydrogen overvoltage properties are typically subject to loss of catalytic activity due to poisoning by inherent impurities present in electrolyte solutions. For example, contaminants present in commercial-scale electrolytic cells, such as iron in an ionic form, may be reduced at the cathode and will eventually plate over a catalytic metal coating. Over a period of time, catalyst performance degrades and results in the cathode performing at an overvoltage level equivalent to a cathode fabricated from the metal impurity. The so-called hydrogen overvoltage, an indicator of cathode performance used by those skilled in the art of electrolysis, for iron is quite high at current densities of 1.5 to 3.5 amps per square inch typically employed in commercial chlor-alkali cells. In contrast, it is desirable to maintain a low hydrogen overvoltage, as generally exhibited by the favorable low hydrogen overvoltage for platinum group metals and platinum group metal oxides, during long-term operation of the cell.

It is, therefore, desirable to develop a cathode possessing a low hydrogen overvoltage that is resistant to poisoning by impurities. It is also desirable that the catalyst be tightly adhered to the substrate to inhibit its loss during operation and, thereby, maintain a low hydrogen overvoltage for the cell.

SUMMARY OF THE INVENTION

The objects addressed above are achieved by an improved electrocatalytic cathode which forms a first aspect of the present invention. The cathode is suitable for use in an electrolytic cell and comprises a metallic-surfaced substrate having tightly adhered thereto a hard, non-dendritic and substantially continuous base layer. The base layer has an inner surface in contact with the metallic-surfaced substrate and an outer surface. The base layer comprises at least one primary electrocatalytic metal having particles of at least one electrocatalytic metal oxide entrapped therein where at least a portion of the electrocatalytic metal oxide particles have part of their surface area exposed and not encapsulated by the primary electrocatalytic metals.

A second aspect of the present invention is an electrocatalytic cathode having a multilayered catalyst coating which is suitable for use in an electrolytic cell. The cathode comprises a base layer that corresponds to the description given in the preceding paragraph. Disposed on the outer surface of the base layer is at least one upper layer. The upper layer comprises a substantially heterogeneous mixture of at least one primary electrocatalytic metal oxide and at least one secondary electrocatalytic metal oxide.

A third aspect is a method for making an electrocatalytic cathode which corresponds to the first aspect of the invention. The method comprises contacting at least one surface of a metallic-surfaced substrate with a coating solution having a pH less than about 2.8. The coating solution comprises a solvent medium, at least one primary electrocatalytic metal ion and particles of at least one electrocatalytic metal oxide. The contact is conducted under conditions and for a time sufficient to deposit a base layer on the surfaces of the metallic-surfaced substrate by non-electrolytic reductive deposition, the base layer containing an effective amount of the primary electrocatalytic metal with the electrocatalytic metal oxide particles entrapped therein.

A fourth aspect is a method of making a cathode having a multilayered catalytic coating thereon corresponding to the second aspect of the invention. The method of the preceding paragraph is conducted to provide the base layer. Thereafter, the base layer is contacted with a second coating solution comprising a second solvent medium, at least one primary electrocatalytic metal oxide precursor compound, at least one secondary electrocatalytic metal oxide precursor compound and, optionally, an etchant capable of etching chemically susceptible portions of the base layer. The substrate is introduced after contact with the second coating solution into an oxidizing environment for a time and under conditions sufficient to convert the primary electrocatalytic metal oxide precursor compounds and the secondary electrocatalytic metal oxide precursor compounds on the base layer to their corresponding oxides.

DETAILED DESCRIPTION OF THE INVENTION

Cathodes prepared according to the invention comprise a metallic-surfaced substrate onto which is deposited a base layer of at least one primary electrocatalytic metal having particles of at least one electrocatalytic metal oxide entrapped therein. The base layer has an inner surface in contact with the substrate and an outer surface. In another embodiment, at least one upper layer comprising a mixture of primary electrocatalytic metal oxides and secondary electrocatalytic metal oxides is formed on the outer surface of the base layer. Each embodiment of the invention is described hereinafter.

I. Cathodes Having an Electrocatalytic Metal and Electrocatalytic Metal Oxide Coating Substrates suitable for use in preparing cathodes according to the invention have surfaces of electrically conductive metals. Such metallic-surfaced substrates may be formed from any metal which retains its physical integrity during both preparation of the cathode and its subsequent use in an electrolytic cell. The substrate may be a ferrous metal, such as iron, steel, stainless steel or another metal alloy wherein a major component is iron. The substrate may also be prepared from nonferrous metals such as copper and nickel. Nickel is preferred as a cathode substrate, since it is resistant to chemical attack within the basic environment of the catholyte in a chlor-alkali cell. Metal laminates comprising a base layer of either a conductive or nonconductive underlying material, with a conductive metal layer affixed to the surface of the underlying material, may also be used as a metallic-surfaced substrate. The means by which the conducting metal is affixed to the underlying material is not critical. For example, a ferrous metal can act as the underlying material and have a layer of a second metal, such as nickel, deposited or welded thereon. Nonconductive underlying materials, such as polytetrafluoroethylene, may be employed when coated with a layer of a conductive metal onto which electrocatalytic metals and electrocatalytic metal oxides are deposited as described hereinafter. Thus, the metallic-surfaced substrate may be entirely metal or an underlying material having a metallic surface.

The configuration of the metallic-surfaced substrate used to prepare the cathodes is not critical. A suitable substrate may, for example, take the form of a flat sheet, a curved surface, a convoluted surface, a punched plate, a woven wire screen, an expanded mesh sheet, a rod, a tube and so on. Preferred substrates are a woven wire screen and an expanded mesh sheet. In some zero-gap chlor-alkali cells, good results are obtained by use of a flexible, thin substrate, such as a fine woven wire screen. In such cells, the present invention allows for retention of substrate flexibility after application of the catalytic coatings. Other electrolytic cells may employ substrates of mesh sheets or flat plate sheets which may be bent to form "pocket" electrodes having substantially parallel sides in a spaced-apart relationship, thereby substantially forming a U-shape when viewed in section.

The metallic-surfaced substrate is preferably roughened prior to contact with a coating solution in order to increase the effective surface area of the cathode. The roughened surface effect is still apparent after deposition of electrocatalytic metals and electrocatalytic metal oxides as disclosed herein. As previously described, an increased surface area lowers the overvoltage requirement. Suitable techniques employed in the art to roughen the surface include sand blasting, chemical etching and the like. The use of chemical etchants is well known and such etchants include most strong inorganic acids, such as hydrochloric acid, sulfuric acid, nitric acid and phosphoric acid. Hydrazine hydrosulfate is also a suitable chemical etchant.

It is advantageous to degrease the metallic-surfaced substrate with a suitable degreasing solvent prior to roughening its surfaces. Removal of grease deposits from the substrate surfaces is desirable, in many instances, to allow chemical etchants to contact the substrate and uniformly roughen the surfaces. Removal of grease also allows for good contact between the substrate and coating solution to obtain a substantially continuous deposition of electrocatalytic metals thereon. Suitable degreasing solvents are common organic solvents such as acetone and lower alkanes, as well as halogenated solvents like CHLOROTHENE® brand solvent, containing inhibited 1,1,1-trichloroethane, which is commercially available from The Dow Chemical Company. Removal of grease is also advantageous where a roughened surface is not desired.

Deposition of the electrocatalytic metal and electrocatalytic metal oxide base layer onto a metallic-surfaced substrate occurs by non-electrolytic reductive deposition. Although not well understood, deposition is believed to be thermodynamically driven and occurs by contacting a surface of the substrate with a coating solution of electrocatalytic metal precursor compounds having a pH of no greater than about 2.8. The contact allows displacement of metal from the substrate surface in exchange for deposition of electrocatalytic metal ions contained in the coating solution. Electrocatalytic metal oxide particles suspended in the coating solution are thereby entrapped by the electrocatalytic metals which deposit on the substrate. The resulting deposit is substantially smooth and non-dendritic in nature, as opposed to dendritic deposits which result from the electrolytic deposition methods previously described. Therefore, the process of the present invention generally deposits a reduced amount of electrocatalytic metals in comparison with the electrolytic methods of preparation previously discussed herein.

Coating solutions include at least one electrocatalytic metal precursor compound. As used herein, the term "electrocatalytic metal precursor compound" refers to a compound that contains, in an ionic form, an electrocatalytic metal capable of being deposited onto the metallic-surfaced substrate by reductive non-electrolytic deposition. In general, a suitable electrocatalytic metal is one that is more noble than the metal employed as a substrate, i.e., the electrocatalytic metal precursor compound has a heat of formation that is greater than the heat of formation for the substrate metal in solution. For example, if nickel is selected as a substrate material and ruthenium trichloride is selected as the electrocatalytic metal precursor compound, the non-electrolytic reductive deposition may be represented by the following chemical reaction $$2RuCl_3 + 3Ni \rightarrow 2Ru + 3NiCl_2$$

The heat of formation for ruthenium trichloride is about −63 kcal/mole, while the heat of formation for nickel dichloride is about −506 kcal/mole. The reaction proceeds due to the greater stability of the products relative to the reactants, i.e., the difference in the heats of formation between ruthenium trichloride and nickel dichloride drives the non-electrolytic reductive deposition. To obtain suitable results, the difference should be at least about 150 kcal/mole and preferably is at least about 300 kcal/mole.

Coating solutions of the present invention include at least one primary electrocatalytic metal precursor compound. Suitable primary electrocatalytic metal precursor compounds include compounds of platinum group metals, such as ruthenium, rhodium, osmium, iridium, palladium and platinum, which are soluble in the solvent medium used to prepare coating solutions as described herein. Preferred compounds are those of platinum, palladium and ruthenium, such as ruthenium halides, palladium halides, platinum halides, ruthenium nitrates and so on.

Secondary electrocatalytic metal precursor compounds may optionally be added to the coating solution to provide additional catalytic effects. However, it is believed that deposition of such metals occurs only to a minor extent, and therefore, the secondary electrocatalytic metals are not essential to the present invention. Secondary electrocatalytic metal precursor compounds correspond to the previous description given for primary electrocatalytic metal precursor compounds, except for the inclusion of metals other than the platinum group metals. Secondary electrocatalytic metal precursor compounds include those which contain nickel, cobalt, iron, copper, manganese, molybdenum, cadmium, chromium, tin and silicon. Examples of suitable secondary electrocatalytic metal compounds are nickel halides and nickel acetates.

Coating solutions are formed by dissolution of the previously described primary electrocatalytic and secondary electrocatalytic metal precursor compounds into a solvent medium. Suitable metal precursor compounds include soluble metal salts selected from the group consisting of metal halides, sulfates, nitrates, nitrites, phosphates and so on. Preferred metal precursor compounds are metal halide salts, with metal chlorides being the most preferred form. A suitable solvent medium is one capable of dissolving the metal precursor compounds and that will allow non-electrolytic deposition to take place. Water is a preferred solvent medium.

The primary electrocatalytic metal ions and secondary electrocatalytic metal ions in the coating solution should be present in amounts sufficient to deposit an effective amount of the metals onto the substrate in a reasonable amount of time. The rate of metal deposition increases at higher metal precursor compound concentrations. The concentration of primary electrocatalytic metal ions in the coating solution is suitably from about 0.01% to about 5%; desirably from about 0.1% to about 2% and preferably from about 0.5% to about 1%, by weight of solution. A primary electrocatalytic metal ion concentration of greater than about 5% is undesired, because an unnecessarily large amount of platinum group metals are used to prepare the solution. A primary electrocatalytic metal ion concentration of less than about 0.01% is undesired, because a long contact time is generally required. If secondary electrocatalytic metals are employed in the coating solution, the concentration of secondary electrocatalytic metal ions in the coating solution is suitably up to about 10%; desirably up to about 5% and preferably up to about 1%, by weight of solution.

Included in coating solutions used to form the base layer are particles of at least one electrocatalytic metal oxide. Such oxides are not soluble in the coating solution and are held in suspension as described hereinafter. Suitable electrocatalytic metal oxides include those of the platinum group metals, such as oxides of ruthenium, rhodium, osmium, iridium, palladium and platinum. Preferred electrocatalytic metal oxides include ruthenium dioxide, palladium oxide, iridium dioxide and platinum dioxide.

The concentration of electrocatalytic metal oxide particles in the coating solution should be sufficient to impart poisoning-resistance to the resulting coating. The concentration of electrocatalytic metal oxides is suitably from about 0.001% to about 0.5%; desirably from about 0.005% to about 0.25% and preferably from about 0.01% to about 0.1%, by weight of the coating solution. A concentration of less than about 0.001% by weight is generally insufficient to provide a desirable amount of poisoning resistance and catalytic effects. A concentration greater than about 0.5% by weight does not provide any greater catalytic effect or poisoning resistance and, therefore, is unnecessary to achieve acceptable results. A concentration greater than about 0.5% by weight is also undesirable due to loss of the particles during operation. At such concentrations, the oxide particles are not as firmly embedded in the electrocatalytic metal component of the resulting coating in comparison with lower concentrations of the oxide particles.

It is important when practicing the present invention to obtain a uniform suspension of the electrocatalytic metal oxide particles in the coating solution. Suitable results are obtained by the use of agitation and adequate control over the size of the oxide particles employed. The method used to impart agitation is not critical and a suitable degree of agitation may be determined without undue experimentation. The amount of agitation is preferably sufficient to prevent a substantial amount of the oxide particles from settling out of the coating solution. If agitation is not sufficient, the particles will settle out of the solution and the coating which results may not be uniform with respect to oxide particle content. It is more important to control the oxide particle size. Smaller oxide particles remain in suspension for a longer period of time and, therefore, require less agitation.

The choice of particle size is somewhat dependent upon the desired thickness of the electrocatalytic metal coating to be deposited on the metallic-surfaced substrate as a layer, hereinafter referred to as the "electrocatalytic metal component" of the base layer. As described in greater detail hereinafter, the thickness of the electrocatalytic metal component of the base layer is preferably from about 1 micron to about 3 microns. Where the deposited layer of electrocatalytic metals has a thickness within this range, the average oxide particle size is suitably less than about 20 microns, beneficially less than about 10 microns, desirably less than about 5 microns, preferably less than about 2 microns and most preferably less than about 0.5 microns. Particle sizes of less than about 10 microns are desirable, because a more uniform suspension is capable of being obtained and maintained during contact between the substrate and the coating solution. A substantially uniform solution is desirable, because smaller oxide particles are more uniformly distributed and firmly entrapped within the resulting coating when compared with results obtained by using larger oxide particles. Coatings incorporating particles having an average size in excess of 20 microns are operable, but they can exhibit an excessive metal oxide particle loss during operation due to insufficient adhesion with the electrocatalytic metal component of the base layer. If a thicker electrocatalytic metal deposit is desired, the ranges previously specified regarding average particle size may be increased proportionately.

Due to a need for the electrocatalytic metal oxide particles to be firmly entrapped in the electrocatalytic metal component of the base layer, the oxide particles employed in the coating solution advantageously have a narrow size distribution. It is desirable for the particles to have a standard deviation of within about 50% of the average particle size and preferably within about 20% of the average particle size. If particles having a standard deviation of greater than about 50% of the average particle size are employed, a large amount of the oxide particles will be lost during operation of the cathode due to poor adhesion with the electrocatalytic metal component of the base layer.

The coating solution should have sufficient acidity to initiate deposition. The solution pH suitably is no greater than about 2.8. The pH desirably is no greater than about 2.4 and preferably is no greater than about 0.8. A pH above about 2.8 will greatly decrease the rate of deposition by non-electrolytic deposition. A pH less than about 0.8 is desirable due to a greatly enhanced rate of deposition relative to a deposition rate at a higher solution pH.

The pH of the coating solution may be adjusted by inclusion of organic acids or inorganic acids therein. Examples of suitable inorganic acids are hydrobromic acid, hydrochloric acid, nitric acid, sulfuric acid, perchloric acid and phosphoric acid. Examples of organic acids are acetic acid, oxalic acid and formic acid. Strong reducing acids, such as hydrobromic acid and hydrochloric acid, are preferred, because they assist with reduction of the electrocatalytic metal ions and serve to etch the substrate surfaces as described hereinafter.

The temperature of the coating solution affects the rate at which the electrocatalytic metals and the electrocatalytic metal oxide particles deposit on the metallic-surfaced substrate. The temperature is suitably maintained at from about 25° C. to about 90° C. Temperatures below about 25° C. are not desirable, since uneconomically long times are required to deposit an effective amount of electrocatalytic metals and electrocatalytic metal oxides on the substrate. Temperatures higher than about 90° C. are operable, but generally result in an excessive amount of metal deposition, as defined hereinafter, or result in a coating having a soft, dendritic surface deposit which is easily dislodged from the substrate. A temperature ranging from between about 40° C. to about 80° C. is desirable, with about 45° C. to about 65° C. being a preferred temperature range.

Contact between the coating solution and substrate surfaces is achieved by any convenient method. Typically, at least one surface of the substrate is sprayed with the coating solution, or it may be applied by painting methods, such as application with a brush or roller. A preferred method is immersion of the substrate in a bath of the coating solution, since the solution temperature can be more accurately controlled. Those skilled in the art will recognize that many equivalent methods exist for contacting the substrate with the solution.

The contact time should be sufficient to deposit an effective amount of the electrocatalytic metals upon the substrate surfaces. An effective amount of deposition provides from about 50 micrograms per square centimeter ("$\mu g/cm^2$") up to an amount less than an excessive amount of deposition, as defined hereinafter, of the primary electrocatalytic metal in an atomic form. The term "atomic form" refers to the total amount of primary electrocatalytic metal, in both elemental and combined oxide forms, on the substrate surfaces as measured by x-ray fluorescence techniques. A desirable loading is from about 400 $\mu g/cm^2$ to about 1800 $\mu g/cm^2$ with a preferred loading being from about 800 $\mu g/cm^2$ to about 1500 $\mu g/cm^2$. Loadings less than about 50 $\mu g/cm^2$ are generally insufficient to provide a satisfactory reduction of cell overvoltage. Loadings greater than an excessive amount of deposition do not result in an increased catalytic effect when compared to lower catalyst loadings. It should be understood that the effective amount of deposition specified above refers to loading of the primary electrocatalytic metals in an atomic form and does not include the secondary electrocatalytic metals which may deposit onto the surfaces This manner of description is necessary due to the difficulty in measuring the relative amounts of each metal on the surface by x-ray fluorescence techniques commonly employed to analyze such coatings. Accordingly, the actual amount of metal and metal oxide particles that deposit on the surfaces will, in most instances, be higher than the ranges previously specified above which refer to readings observable by x-ray fluorescence.

The deposit of an effective amount of electrocatalytic metals provides an electrocatalytic metal component of the base layer having a thickness suitably of from about 0.01 microns to about 15 microns. The component layer desirably has a thickness of from about 0.05 microns to about 5 microns and preferably from about 1 micron to about 3 microns. A thickness greater than about 15 microns provides no particular advantage with respect to catalytic effect and, therefore, is not an economical use of the metals employed. The term "excessive amount" as used herein refers to an electrocatalytic metal component thickness greater than about 15 microns with the metal oxide particles entrapped therein as previously described. However, due to exposure of the metal oxide particle surface through the electrocatalytic metal component, the overall base layer thickness will be somewhat greater depending upon the size of the electrocatalytic metal oxide particles employed.

The time allowed for contact between the metallic-surfaced substrate and coating solution can suitably vary from about one minute to about 50 minutes. Contact times of from about five minutes to about 30 minutes are desirable, with from about 10 minutes to about 20 minutes being preferred. Metals will deposit onto the substrate at times of less than one minute, but the amount of deposition is generally insufficient to provide an effective amount of electrocatalytic metals and metal oxide particles and, therefore, requires numerous, repeated contacts with the coating solution. However, if shorter contact times are desired, the method of the present invention may be repeated a plurality of times until an effective amount of electrocatalytic metals deposit on the surfaces of the substrate. Times in excess of about 50 minutes provide no discernible advantage, because an unnecessary and excessive amount of electrocatalytic metals will deposit. It has been observed that times in excess of about 50 minutes are also undesirable, because the outer surface of the metal component layer may develop a soft, dendritic and powder-like consistency and, therefore, a portion of the electrocatalytic metal and metal oxide particles is easily removed. It should also be understood that the contact time will vary with coating solution temperature, pH and electrocatalytic metal ion concentration, but the time required in such cases may be optimized by those skilled in the art, in view of this disclosure, without undue experimentation.

It is advantageous to rinse the coated substrate with water or other inert fluid after contact with the coating solution, especially where a strong acid, such as hydrochloric acid, is incorporated in the coating solution. The rinse minimizes possible removal of deposited metals from the coated substrate due to corrosive action by the acid.

After contact with the coating solution, it may be beneficial, but not essential, to heat the coated substrate in an oxidizing environment. It is believed that thermal treatment of the coated substrate serves to anneal the electrocatalytic metal component layer. Also, to the extent any electrocatalytic metal precursor compounds remain on the coated substrate, such thermal treatment will convert the compounds to their corresponding metal oxides and provide additional electrocatalytic effect. A suitable thermal treatment method is to heat the coated substrate in an oven in the presence of air. Thermal oxidation methods are taught in U.S. Pat. No. 4,584,085, the relevant teachings of which are incorporated herein by reference.

Temperatures at which the metal precursor compounds thermally oxidize depend to a limited extent upon the metal precursor compounds employed in a given coating solution. In general, suitable temperatures are from about 300° C. to about 650° C. It is preferred to conduct thermal oxidation at from about 450° C. to about 550° C., because substantially all residual electrocatalytic metal precursor compounds are converted to metal oxides in this temperature range. The time required for this heat treatment is not particularly critical and may suitably range from about 20 minutes to about 90 minutes.

The electrocatalytic metals form a hard, non-dendritic, and substantially continuous base layer on the substrate surfaces, referred to herein as "the electrocatalytic metal component of the base layer", with at least a portion of the metal oxide particles being entrapped therein. By the term "entrapped", it is meant that the metal oxide particles are fixedly adhered to the substrate by occlusion within the electrocatalytic metal component of the base layer. A portion of the metal oxide particles may be fully encapsulated within the electrocatalytic metal component, especially where the average particle size of such particles is less than the thickness of the electrocatalytic metal component of the base layer. However, it is important that at least a portion of the electrocatalytic metal oxide particles have part of their surface area exposed, i.e., not fully encapsulated within the electrocatalytic metal component. It is believed that exposed metal oxide particles impart poisoning resistance to the coating and mechanical stability for upper oxide layers in multilayered catalyst coatings described hereinafter.

In terms of composition, the base layer suitably has an electrocatalytic metal content of from about 95% to about 50% and an electrocatalytic metal oxide particle content of from about 5% to about 50% by weight of the base layer. A metal oxide particle content of less than about 5% by weight is undesirable due to insufficient poisoning resistance. A metal oxide particle content of greater than about 50% by weight is undesirable due to insufficient metal oxide particle adherence. Preferred coatings exhibit an electrocatalytic metal content of from about 75% to about 60% and an electrocatalytic metal oxide particle content of from about 25% to about 40% by weight of the base layer.

The method previously described provides an electrocatalytic cathode comprising a metal or metallic-surfaced substrate onto which is deposited a hard, non-dendritic, and substantially continuous base layer comprising at least one primary electrocatalytic metal, particles of at least one electrocatalytic metal oxide and, optionally, at least one secondary electrocatalytic metal. The base layer is tightly adherent to the metal or metal surfaced substrate, thereby making both the base layer and substrate, taken in combination, useful as a cathode in an electrolytic cell.

II. Cathodes With Multilayered Coatings

Another aspect of the present invention is an electrocatalytic cathode having a multilayered catalytic coating composition thereon suitable for use in electrolytic cells, such as a chlor-alkali cell as previously described. The composition is affixed by deposition onto a substrate and is made up of a base layer and at least one upper oxide layer. The base layer is comprised of primary electrocatalytic metals, electrocatalytic metal oxide particles and optional secondary electrocatalytic metals as previously described herein. The base layer has an inner surface in contact with the substrate and an outer surface. The upper oxide layers of the multilayered coating are disposed on the outer surface of the base layer and comprise a substantially heterogeneous mixture of primary electrocatalytic metal oxides and secondary electrocatalytic metal oxides.

The multilayered composition may be formed by first utilizing the method previously described herein to form the base layer. Thereafter, the base layer is contacted with a second coating solution comprising primary electrocatalytic metal oxide precursor compounds and secondary electrocatalytic metal oxide precursor compounds. The so-coated substrate is then heated within an oxidizing environment to convert the metal oxide precursor compounds to their oxides and thereby provide an upper oxide layer. In general, placement of the upper oxide layer corresponds to methods described in U.S. Pat. Nos. 4,572,770; 4,584,085 and 4,760,041, the teachings of which are incorporated herein by reference.

The second coating solution is formed by dissolution of at least one primary electrocatalytic metal oxide precursor compound and at least one secondary electrocatalytic metal oxide precursor compound into a second solvent medium. The primary electrocatalytic metal oxide precursor compounds correspond to those previously described for the primary electrocatalytic metal precursor compounds. Similarly, the secondary electrocatalytic metal oxide precursor compounds correspond to those previously described for the secondary electrocatalytic metal precursor compounds.

Suitable second solvent mediums include any polar solvent capable of dissolving the metal oxide precursor compounds to be employed in the second coating solution. It is also preferred that the second solvent be readily volatilized at temperatures employed for conversion of the metal oxide precursor compounds to their oxides. Examples of suitable second solvents are water and most common organic alcohols, such as methanol, ethanol, 1-propanol and 2-propanol, as well as other common organic solvents like dimethylformamide, dimethylsulfoxide, acetonitrile and tetrahydrofuran. Preferred second solvents are water and common organic alcohols. The solvents may be used singly or in combination with other second solvents.

The primary electrocatalytic metal oxide precursor compounds and the secondary electrocatalytic metal oxide precursor compounds in the second coating solution are present in amounts that are sufficient to allow formation of a sufficient amount of electrocatalytic metal oxides on the substrate. In general, good results are obtained where the concentration of primary electrocatalytic metal ions in the coating solution is suitably from about 0.5% to about 3.5%; desirably from about 1.5% to about 3.0% and preferably from about 2.0% to about 2.5% by weight of the solution. Generally, the concentration of secondary electrocatalytic metal ions in the second coating solution should be sufficient to provide a molar ratio of the secondary electrocatalytic metal ions to the primary electrocatalytic metal ions in the solution of from about 2:1 to about 1:2. The molar ratio is desirably from about 1.5:1 to about 1:1.5, preferably from about 1.1:1 to about 0.9:1 and most preferably about 1:1.

The second coating solution optionally contains an etchant capable of etching the most chemically susceptible portions of the base layer. The etchant is preferably capable of being volatilized along with anions from the primary electrocatalytic metal oxide precursor compounds and the secondary electrocatalytic metal oxide precursor compounds in subsequent thermal treatments. Suitable etchants include strong inorganic acids, such as hydrochloric acid, sulfuric acid, nitric acid and phosphoric acid. Hydrazine hydrosulfate and most peroxides are also acceptable etchants. Preferred etchants are hydrochloric acid, hydrogen peroxide and hydrazine hydrosulfate. Etchants may be used singly or in combination.

The amount of etchant added to the solution is not critical, so long as the amount is sufficient to provide a desired degree of roughness on the substrate surfaces. In general, suitable results are obtained where the etchant is present in an amount sufficient to yield a weight ratio of etchant to the solvent of from about 0.05 to about 0.1.

Contact between the coated substrate and the second coating solution is achieved by any convenient method. Examples previously given above for non-electrolytic reductive deposition of the base layer are suitable, such as immersion, painting with a brush or a roller, or spraying. Suitable contact times are from about 30 seconds to about 5 minutes, but the time allowed for contact is not critical. Any means of contact which allows the surfaces to be substantially wetted by the second coating solution is suitable.

It is advantageous to dry the surfaces of the coated substrate after contact with the second coating solution to remove the solvent thereon, especially where a flammable solvent is selected. Drying the substrate is not critical where the solvent is not flammable.

After contact with the second coating solution, conversion of the metal oxide precursor compounds to their oxides is achieved by introducing the coated substrate into an oxidizing environment. The oxidizing environment is maintained at a temperature sufficient to convert the metal oxide precursor compounds to their corresponding oxides. The temperature at which the metal oxide precursor compounds are converted is somewhat dependent upon the particular metals employed, but generally, suitable temperatures range from about 250° C. to about 650° C. It is preferred to conduct thermal oxidation at a temperature of from about 450° C. to about 550° C., because substantially all metal oxide precursor compounds are converted to their oxides. The time required for this thermal treatment is not particularly critical and suitably ranges from about 20 minutes to about 90 minutes. A preferred oxidizing environment includes the presence of oxygen or an oxygen-containing gas such as air.

A plurality of upper metal oxide layers is preferably formed to attain the best effect of the invention. It has been discovered that forming a plurality of upper oxide layers may significantly reduce catalyst loss for some flexible substrates, such as a woven wire screen, during operation of the cathode. However, the optimum number of coats will depend upon the flexibility of the particular substrate used to prepare the cathode. Where the substrate is a flexible, woven wire screen, best results with respect to minimizing catalyst loss are generally obtained by successively forming from about two to about six metal oxide upper layers.

After formation of the upper oxide layer or layers, the amount of electrocatalytic metals, in an atomic form, deposited on the substrate surfaces suitably correspond to an effective amount of deposition as previously described herein.

According to this aspect of the invention, the method preferably comprises contacting a metallic-surfaced substrate coated with a base layer, as previously described herein, with a second coating solution. The second coating solution comprises at least one primary electrocatalytic metal oxide precursor compound, such as ruthenium trichloride; at least one secondary electrocatalytic metal oxide precursor compound, such as nickel dichloride; a concentrated, 37% by weight, aqueous hydrochloric acid solution, as an etchant; and isopropanol, a second solvent medium. Volatile components of the second coating solution are allowed to evaporate, leaving the metal oxide precursor compounds. The substrate is then heated in the presence of an oxidizing environment, such as an air-fed oven, wherein the anions of the metal oxide precursor compounds are volatilized and the metals converted to their oxides. The effect of the contact and subsequent thermal treatment is to put in place a hard and substantially continuous upper oxide layer comprising a substantially heterogeneous mixture of electrocatalytic metal oxides, such as ruthenium dioxide, a primary electrocatalytic metal oxide, and nickel oxide, a secondary electrocatalytic metal oxide, on the base layer.

Specific Embodiments of the Invention

The following examples illustrate the present invention and should not be construed, by implication or otherwise, as limiting the scope of the appended claims.

EXAMPLES 1-3

Preparation of Cathodes Having a Coating of Electrocatalytic Metal and Electrocatalytic Metal Oxide Particles Examples 1-3 each concern preparation of a cathode having an electrocatalytic metal and electrocatalytic metal oxide coating and to the function of the cathode in an electrolytic cell. The procedure used for preparing all three cathodes is the same, except with respect to immersion times in a coating solution.

Initially, a coating solution is prepared by mixing 3.00 grams of ruthenium trichloride monohydrate, a primary electrocatalytic metal precursor compound: 3.00 grams of nickel dichloride hexahydrate, a secondary electrocatalytic metal precursor compound: 0.06 grams of palladium dichloride, another primary electrocatalytic metal precursor compound; and 0.05 grams of ruthenium dioxide particles, particles of an electrocatalytic metal oxide: with 7.0 milliliters of a 37% aqueous solution of hydrochloric acid, an etchant and pH adjustment means, and 150 milliliters of deionized water, a solvent medium, in a glass beaker. The mixture is stirred overnight to allow complete dissolution of solids, except for the ruthenium dioxide particles.

The ruthenium dioxide particles are obtained commercially from Johnson, Matthey & Co., Ltd., in a powder form marketed as 800/2JX. The ruthenium dioxide powder has an average particle size of about 0.14 microns according to specifications supplied by the manufacturer.

Cathodes are prepared by immersion of three metallic-surfaced substrates in the previously described coating solution. The metallic-surfaced substrates are each three inch by three inch pieces of a woven nickel wire screen. The screen is fabricated from nickel wire having a diameter of 0.010 inches and has 25 wire strands per inch. Prior to contact with the solution, the substrate surfaces are first degreased with CHLOROTHENE® brand solvent containing 1,1,1-trichloroethane which is commercially available from The Dow Chemical Company. After degreasing, the substrates are roughened by sandblasting. The roughened substrates are each immersed in the coating solution which is maintained at a temperature of about 55° C. In Example 1, the substrate is continuously immersed in the coating solution for a period of about five minutes. In Example 2, another substrate is immersed for about 10 minutes and in Example 3, the remaining substrate is immersed for about 15 minutes. The coating solution is agitated by hand stirring at one minute intervals during the time the substrates are immersed therein. In all three examples, after immersion the substrates are rinsed with water and allowed to air dry.

The loading of ruthenium in an atomic form, i.e., as both a free metal and combined with oxygen, is measured by x-ray fluorescence using a Texas Nuclear Model #9256 digital analyzer. The analyzer is equipped with a cadmium 109, 5 millicurie source, and filters, also commercially available from Texas Nuclear, that are optimized for measuring ruthenium in the presence of nickel. The analyzer provides a measurement that is then compared with a standard having a known ruthenium loading to calculate a measured ruthenium loading. Measurements using the analyzer are taken at four evenly spaced locations on both sides of each mesh screen, with all eight measurements being used to calculate an average ruthenium loading. The average loadings of ruthenium for Examples 1-3 are given in Table 1.

To analyze operation of the three coated substrates in a chlor-alkali cell environment, the substrates are each tested as a cathode in a test bath containing 32% sodium hydroxide maintained at a temperature of about 90° C. The cathodes are attached to a current distributing electrode made of 0.070 inch thick, 40% expanded nickel mesh which is connected to a negative current source and immersed in the test bath. A three inch by three inch piece of platinum foil is used as an anode. The anode is placed within an envelope of Nafion® ion exchange membrane material, a perfluorosulfonic acid membrane, available commercially from E. I. DuPont DeNemours & Co., and then immersed in the bath. The cells are operated at a current density of about 2.0 amps per square inch, or about 0.31 amps per square centimeter, to produce oxygen gas at the anode and hydrogen gas and aqueous sodium hydroxide at the cathode.

The potentials for each cathode are measured after about 20 minutes of steady state operation at the above-identified conditions. The cathode potentials are measured using a mercury/mercuric oxide reference electrode and a Luggin probe at the previously given current density. The results of the cathode potential measurements are reported in Table 1. After one hour of electrolysis, the cathodes are removed from the bath and the loading of ruthenium remaining after operation in the bath is determined in the same manner as previously described. The loading of ruthenium after operation, as well as the calculated ruthenium loss, for each cathode is also reported in Table 1.

TABLE 1

Cathodes Prepared from a Coating Solution Containing 0.32 grams/liter $RuO_2$ Particles

| Example No. | Immersion Time (min.) | Ru Loading ($\mu g/cm^2$) | Cathode Potential (volts) | Ru Loading After 1 Hour ($\mu g/cm^2$) | Ru Catalyst Loss ($\mu g/cm^2$) |
|---|---|---|---|---|---|
| 1 | 5 | 1313 | −0.998 | 1227 | 86 |
| 2 | 10 | 1779 | −0.996 | 1582 | 196 |
| 3 | 15 | 3106 | −0.997 | 2473 | 633 |

EXAMPLE 4-6

The procedure of Examples 1-3 is substantially repeated for three additional substrates, respectively, except that 0.20 grams of the ruthenium dioxide particles described above are incorporated in the coating solution. The results for ruthenium loading, ruthenium loss and potential for each cathode are given in Table 2.

TABLE 2

Cathodes Prepared from a Coating Solution Containing 1.3 Grams/Liter $RuO_2$ Particles

| Example No. | Immersion Time (min.) | Ru Loading ($\mu g/cm^2$) | Cathode Potential (volts) | Ru Loading After 1 Hour ($\mu g/cm^2$) | Ru Catalyst Loss ($\mu g/cm^2$) |
|---|---|---|---|---|---|
| 4 | 5 | 1168 | −1.000 | 1062 | 106 |
| 5 | 10 | 2498 | −0.999 | 2313 | 185 |
| 6 | 15 | 3013 | −1.000 | 2621 | 392 |

EXAMPLES 7-10

Preparation of Cathodes Having a Multilayered Coating

Examples 7-10 concern preparation of four cathodes having a catalytic coating comprising a base layer of electrocatalytic metal with entrapped electrocatalytic metal oxide particles and at least one upper metal oxide layer. The procedure used for all four cathodes is substantially the same, except with respect to the number of upper oxide layers formed.

The procedure followed in Examples 1-3 is substantially repeated for application of the base layer to four substantially identical substrates, the base layer consisting largely of ruthenium metal with ruthenium dioxide particles entrapped therein. However, only 6 milliliters of the hydrochloric acid solution is added to the coating solution, as opposed to the 7 milliliters used in Examples 1-3. After contact with the coating solution, the coated substrates are rinsed with water and placed in an oven maintained at a temperature of about 475°-500° C. for about 30 minutes.

A second coating solution is prepared for use in forming the upper oxide layers. The solution is prepared by mixing 3.00 grams of ruthenium trichloride monohydrate, a primary electrocatalytic metal oxide precursor compound: 3.00 grams of nickel dichloride hexahydrate, a secondary electrocatalytic metal oxide precursor compound; 7.0 milliliters of a 37% aqueous solution of hydrochloric acid, an etchant: and 150 milliliters of isopropanol, a second solvent medium, in a beaker. The mixture is stirred overnight to allow complete dissolution of solids.

The coated substrates having the base layer in place are immersed in the second coating solution for about five minutes. The coated substrates are removed from the second coating solution and allowed to dry. The dried substrates are placed in a Blue M, Model #CW-5580F oven maintained at a temperature of about 475°-500° C. for about 30 minutes to convert the metal oxide precursor compounds on the substrate surfaces to their corresponding oxides. The procedure of this paragraph is repeated once for Example 8 (resulting in formation of two upper oxide layers), twice for Example 9 (resulting in three upper oxide layers) and three times for Example 10 (resulting in four upper oxide layers).

The loading of ruthenium after application of the upper layers is determined according to the procedure used in Examples 1-3. The ruthenium loading results are reported in Table 3.

The four coated substrates are tested as cathodes in a sodium hydroxide bath under the same conditions and for one hour as in Examples 1-3. The cathode potentials and ruthenium loss are measured as in Examples 1-3 and are reported in Table 3.

TABLE 3

Cathodes With Multilayered Catalyst Coatings

| Example | # of Upper Layers | Ru Loading ($\mu g/cm^2$) | Cathode Potential (volts) | Ru Loading After 1 Hour ($\mu g/cm^2$) | Ru Catalyst Loss ($\mu g/cm^2$) |
|---|---|---|---|---|---|
| 7 | 1 | 1120 | −1.002 | 989 | 131 |
| 8 | 2 | 1191 | −0.992 | 1113 | 78 |
| 9 | 3 | 1209 | −0.992 | 1138 | 71 |
| 10 | 4 | 1218 | −1.003 | 1154 | 63 |

The results show that application of the upper oxide layers reduces the amount of ruthenium catalyst loss during operation without adversely affecting the hydrogen overvoltage potential. Similar results are expected using other substrates and coating compositions as disclosed herein.

What is claimed is:

1. A method of making an electrocatalytic cathode comprising contacting at least one surface of a metallic-surfaced substrate with a coating solution having a pH less than about 2.8, the coating solution comprising a solvent medium, at least one primary electrocatalytic metal ion and particles of at least one electrocatalytic metal oxide, the contact being under conditions and for a time sufficient to deposit a base layer on the surfaces of the substrate by non-electrolytic reduction deposition, the base layer containing an effective amount of the primary electrocatalytic metal with the electrocatalytic metal oxide particles entrapped therein.

2. The method of claim 1 wherein the coating solution has an electrocatalytic metal oxide particle concentration of from about 0.001% to about 0.5% by weight of the solution.

3. The method of claim 1 wherein the coating solution has an electrocatalytic metal oxide particle concentration of from about 0.01% to about 0.1% by weight of the solution.

4. The method of claim 1 wherein the electrocatalytic metal oxide particles have an average particle size of less than about 20 microns.

5. The method of claim 1 wherein the electrocatalytic metal oxide particles have an average particle size of less than about 0.5 microns.

6. The method of claim 1 wherein the primary electrocatalytic metal ions are selected from the group consisting of ions of ruthenium, rhodium, osmium, iridium, palladium and platinum.

7. The method of claim 1 wherein the coating solution has a primary electrocatalytic metal ion concentration of from about 0.01% to about 5% by weight of solution.

8. The method of claim 1 wherein the solvent medium is water.

9. The method of claim 1 wherein the coating solution further comprises at least one secondary electrocatalytic metal ion selected from the group consisting of ions of nickel, cobalt, iron, copper, manganese, molybdenum, cadmium, chromium, tin and silicon.

10. The method of claim 9 wherein the coating solution has a secondary electrocatalytic metal ion concentration of up to about 10% by weight of the solution.

11. The method of claim 1 wherein the metallic-surfaced substrate comprises a metal selected from the group consisting of nickel, iron, steel, stainless steel, copper, and alloys thereof.

12. The method of claim 1 wherein the metallic-surfaced substrate is a laminate comprising a layer of an underlying material with a conductive layer of metal selected from the group consisting of nickel, iron, steel, stainless steel, copper, and alloys thereof affixed to the underlying material.

13. The method of claim 1 wherein the contact occurs for a period of from about 1 minute to about 50 minutes.

14. The method of claim 1 wherein the pH is no greater than about 0.8.

15. The method of claim 1 wherein the conditions include a coating solution temperature of from about 25° C. to about 90° C.

16. The method of claim 1 wherein the conditions include a coating solution temperature of from about 45° C. to about 65° C.

17. The method of claim 1 wherein the base layer has from about 50 $\mu g/cm^2$ up to an amount less than an excessive amount of deposition of the primary electrocatalytic metals in an atomic form.

18. The method of claim 1 wherein the base layer has from about 800 $\mu g/cm^2$ to about 1500 $\mu g/cm^2$ of the primary electrocatalytic metals in an atomic form.

19. The method of claim 1 wherein the base layer has a thickness of from about 0.01 microns to about 15 microns.

20. The method of claim 1 wherein the effective amount of deposition is obtained by repeated contact between the surfaces and the coating solution.

21. A cathode produced according to claim 1.

22. The method of claim 1 further comprising two additional steps of (1) contacting the base layer with a second coating solution comprising a second solvent medium, at least one primary electrocatalytic metal oxide precursor compound, at least one secondary electrocatalytic metal oxide precursor compound and, optionally, an etchant capable of etching chemically susceptible portions of the base layer and (2) introducing the substrate after contact with the second coating solution into an oxidizing environment for a time and under conditions sufficient to convert the primary electrocatalytic metal oxide precursor compounds and the secondary electrocatalytic metal oxide precursor compounds on the base layer to their corresponding oxides.

23. The method of claim 22 wherein the primary electrocatalytic metal oxide precursor compounds are selected from the group consisting of compounds of ruthenium, rhodium, osmium, iridium, palladium and platinum.

24. The method of claim 22 wherein the secondary electrocatalytic metal oxide precursor compounds are selected from the group consisting of compounds of nickel, cobalt, iron, copper, manganese, molybdenum, cadmium, chromium, tin and silicon.

25. The method of claim 22 wherein the primary electrocatalytic metal oxide precursor compounds and the secondary electrocatalytic metal oxide precursor compounds are selected from the group consisting of metal halides, nitrates, nitrites, sulfates and phosphates.

26. The method of claim 22 wherein the second coating solution has a primary electrocatalytic metal ion concentration of from about 0.5% to about 3.5% by weight of the solution.

27. The method of claim 22 wherein the second coating solution has a molar ratio of the secondary electrocatalytic metal ions to the primary electrocatalytic metal ions in the second coating solution of from about 2:1 to about 1:2.

28. The method of claim 22 wherein the etchant is selected from the group consisting of hydrochloric acid, sulfuric acid, nitric acid, phosphoric acid, hydrazine hydrosulfate, perchloric acid, and mixtures thereof.

29. The method of claim 22 wherein the etchant is present in the second coating solution at a weight ratio of etchant to the second solvent medium of from about 0.05 to about 0.1.

30. The method of claim 22 wherein the second solvent medium is selected from the group consisting of water, methanol, ethanol, 1-propanol, 2-propanol, dimethylformamide, dimethylsulfoxide, acetonitrile and tetrahydrofuran.

31. The method of claim 22 wherein the oxidizing environment includes an oxygen-containing gas.

32. The method of claim 31 wherein the oxygen-containing gas is air.

33. The method of claim 22 wherein the conditions include maintaining a temperature of from about 300° C. to about 650° C.

34. The method of claim 22 wherein the time is from about 20 minutes to about 90 minutes.

35. The method of claim 22 wherein the two additional steps are repeated at least once.

36. The method of claim 22 wherein the two additional steps are repeated from one to about five times.

37. A cathode produced by the method of claim 22.

* * * * *